United States Patent [19]

Bloom

[11] Patent Number: 4,670,916

[45] Date of Patent: Jun. 9, 1987

[54] TOILET BOWL DISPENSER

[75] Inventor: Stephen A. Bloom, Miami Beach, Fla.

[73] Assignee: Sitting Pretty, Inc., Miami Beach, Fla.

[21] Appl. No.: 799,955

[22] Filed: Nov. 20, 1985

[51] Int. Cl.[4] ..... E03D 9/02

[52] U.S. Cl. ..... 4/231; 4/222; 4/223; 239/274; 239/579; 222/402.15

[58] Field of Search ..... 4/222–225, 4/227–233, 622; 222/135, 205, 402.15; 239/274, 579, 344; 297/217, 180

[56] References Cited

U.S. PATENT DOCUMENTS

| | | | |
|---|---|---|---|
| 367,495 | 8/1987 | Angell . | |
| 548,870 | 10/1895 | Hager | 4/223 |
| 713,977 | 11/1902 | Gallagher | 4/229 |
| 1,108,911 | 9/1914 | Klein . | |
| 1,241,231 | 9/1917 | Macy . | |
| 1,495,644 | 5/1924 | Poussin . | |
| 1,712,816 | 5/1929 | Elliott . | |
| 2,081,249 | 5/1937 | Pryba . | |
| 2,795,799 | 6/1957 | Dickerman | 4/222 |
| 2,812,119 | 11/1957 | Bethune | 4/224 |
| 3,088,125 | 5/1963 | Southwood | 4/222 |
| 3,130,873 | 4/1964 | Klutz, Jr. | 222/135 |
| 3,143,745 | 8/1964 | Price . | |
| 3,178,070 | 4/1965 | Leland | 4/233 |
| 3,249,951 | 5/1966 | Thompson . | |
| 3,336,603 | 8/1967 | Leland | 4/223 |
| 3,344,441 | 10/1967 | Kelly . | |
| 3,420,445 | 1/1969 | Inzerill | 4/223 |
| 3,575,319 | 4/1971 | Safianoff | 222/135 |
| 3,605,133 | 9/1971 | Quercia et al. | 4/231 |
| 4,031,574 | 6/1977 | Werner . | |
| 4,063,316 | 12/1977 | Hunninghaus . | |
| 4,183,105 | 1/1980 | Womack . | |
| 4,344,194 | 8/1982 | Pearson . | |

FOREIGN PATENT DOCUMENTS

| | | | |
|---|---|---|---|
| 608563 | 11/1960 | Canada | 239/274 |
| 1293641 | 4/1962 | France | 239/274 |
| 1364063 | 8/1974 | United Kingdom | 4/228 |

*Primary Examiner*—Stephen Marcus
*Assistant Examiner*—Linda J. Sholl
*Attorney, Agent, or Firm*—Kelly, Bauersfeld & Lowry

[57] ABSTRACT

The invention relates to an improved system for dispensing deodorant, disinfectant and cleaning materials into or around a toilet bowl and, particularly, to a U-shaped bracket for mounting a dispensing container onto the rim of the toilet bowl. The U-shaped bracket comprises a cross member which fits transversely over the top of the rim, a pair of depending legs, one of which has a means to hold a dispensing container and a pair of arms on the cross member which engage the underside of the toilet seat and support the seat without transmitting any turning or twisting motion to the bracket. One of the arms extends over the valve on the dispensing container and actuates the valve to dispense material when the toilet seat moves in a vertical direction.

10 Claims, 8 Drawing Figures

FIG. 4
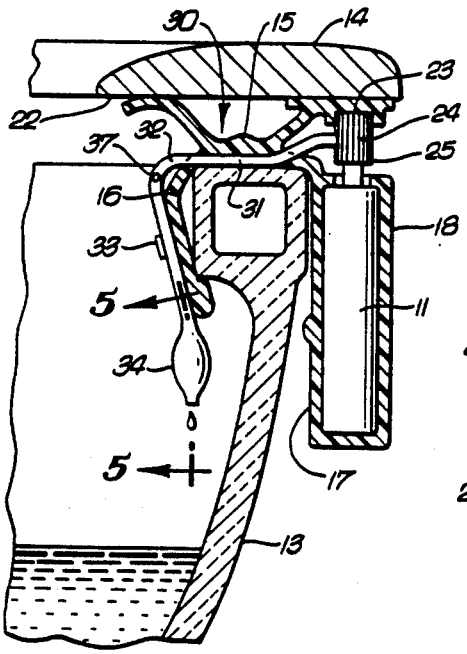
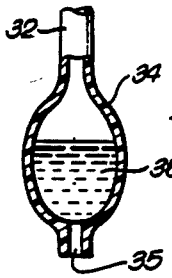
FIG. 5
FIG. 6
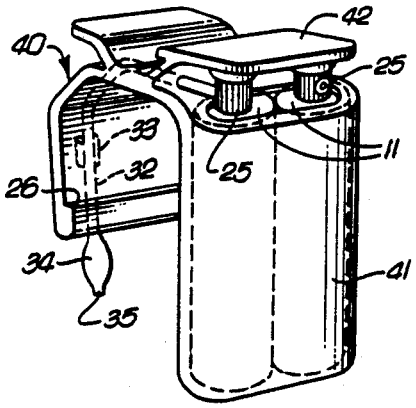
FIG. 7
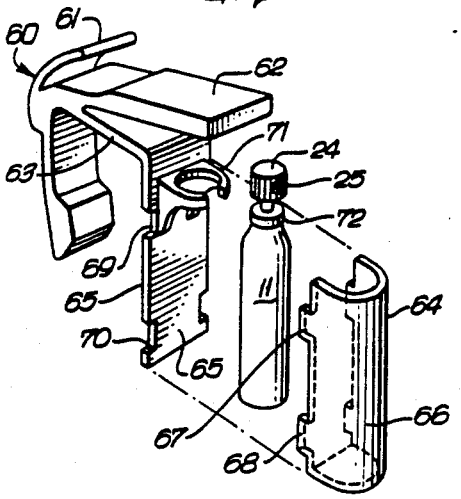
FIG. 8
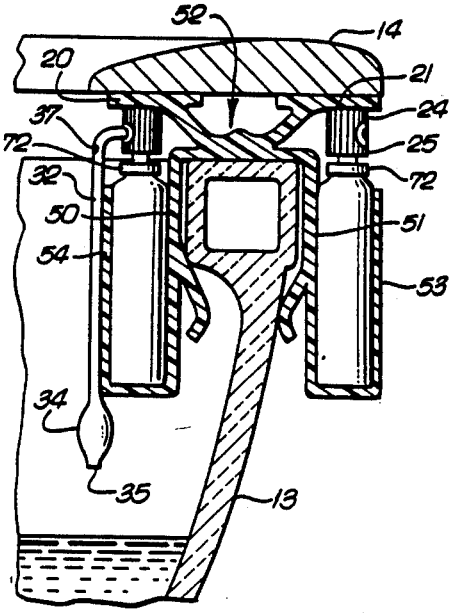

TOILET BOWL DISPENSER

BACKGROUND OF THE INVENTION

This invention relates to a dispensing device and a mounting system therefor for use on toilet bowls.

Over the years there have been a wide variety of dispensing devices for dispensing materials such as deodorants, disinfectants, cleaning agents and the like into or around toilets. Reference is made to the exemplary patents listed below which describe such devices. The list is not meant to be exhaustive on the subject.

U.S. Pat. No. 367,495, Angell, 1887; U.S. Pat. No. 1,108,911, Klein, 1914; U.S. Pat. No. 1,241,231, Macy, 1917; U.S. Pat. No. 1,495,644, Poussin, 1924; U.S. Pat. No. 1,712,816, Elliott, 1929; U.S. Pat. No. 2,081,249, Pryba, 1937; U.S. Pat. No. 3,143,745, Price, 1964; U.S. Pat. No. 3,178,070, Leland, 1965; U.S. Pat. No. 3,249,951, Thompson, 1966; U.S. Pat. No. 3,344,441, Kelly, 1967; U.S. Pat. No. 3,336,603, Leland, 1967; U.S. Pat. No. 3,420,445, Inzerill, 1969; U.S. Pat. No. 3,605,133, Quercia et al., 1971; U.S. Pat. No. 4,031,574, Werner, 1977; U.S. Pat. No. 4,063,316, Hünninghaus, 1977; U.S. Pat. No. 4,183,105, Womack, 1980; U.S. Pat. No. 4,344,194, Pearson, 1982; Canadian Patent No. 608,563, Tavernier, 1960.

The devices shown in U.S. Pat. No. 3,605,133, U.S. Pat. No. 3,336,603 and U.S. Pat. No. 3,178,070 and Canadian Patent No. 608,563 are of interest inasmuch as they describe brackets which are suitable for mounting on the rim of a toilet bowl and, further, which support dispensing containers for aerosol and liquid materials. U.S. Pat. No. 3,605,133 and Canadian Patent No. 608,563 are of particular interest from the standpoint that the dispensing containers are actuated by the vertical movement of the toilet seat when a user either sits on or rises from the seat.

The container support and mounting structure for many of the prior art devices has not been very sturdy or effective. The bracket-type supporting units mounted on the rim of the toilet seat tend to move about, particularly when the toilet seat is employed to engage and actuate the valve of the dispensing container. Gluing or otherwise fixing the support bracket to the edge of the toilet bowl has not been very attractive because then the bracket cannot be readily removed and, if it is removed, the adhesive or other connector tends to deface the surface of the toilet bowl.

Thus, a need remains for a simple, yet effective system for dispensing deodorants, disinfectants, and cleaning agents into and surrounding toilet bowls, and particularly, for a bracket for holding dispensing containers onto the toilet bowl rim. The present invention satisfies this need.

SUMMARY OF THE INVENTION

This invention is directed to a system for mounting a dispensing device for deodorants, disinfectants, cleaning agents and the like onto the rim of a toilet bowl wherein the dispensing function is actuated by the user either sitting on or rising from the toilet seat.

In accordance with this invention, the mounting system includes an inverted U-shaped support bracket which clamps over the rim of the toilet bowl and which is provided with means to hold a dispensing container in an upright position so that vertical movement of the toilet seat actuates the dispenser valve on the container. The inverted U-shaped support bracket comprises a cross member which is shaped to fit transversely over the top surface of the toilet bowl rim and two depending legs, at least one of which snugly engages the lower portion of the rim to hold the bracket on the rim. In this regard, the inner surface of one of the depending legs is provided with a shoulder or flange which engages the lower edge of the toilet bowl rim to facilitate such positioning.

At least one of the depending legs is provided with means such as a cylindrical chamber open at the upper end thereof to hold one or more dispensing containers in an upright position so that the actuating valve or valves thereof which extend out of the open end holding chamber can be actuated by vertical movement of the toilet seat.

Two upwardly and outwardly extending arms or levers are fixed to the upper portion of the cross member which function to flexibly engage the underside of the toilet seat in a manner so that essentially no rotational motions are transmitted to the support bracket when someone sits on the toilet seat, i.e., the pressure applied to the rim by the support bracket is essentially perpendicular to the upper surface of the rim.

Preferably, one of the arms or levers is adapted to directly or indirectly engage the valve of the dispensing container to cause the dispensing of the contents thereof. One of the arms extends outwardly over the dispensing container held in an upright position on one of the dispensing legs so that the arm actuates the valve on the dispensing container when the toilet seat moves vertically.

In one alternate embodiment, one of the depending legs can be provided with means to support a plurality of aerosol or liquid dispensing containers. In another embodiment, a dispenser container support means can be provided on each of the depending legs. In this latter embodiment, one of the containers may be provided with deodorizing agents which are dispersed into the air surrounding the toilet, whereas the other container may be used to dispense disinfectants into the toilet bowl itself.

The means to actuate the dispensing valves on the containers can be arranged so that the valve is actuated either when the user sits on the toilet or when the user arises therefrom.

The present invention provides an improved dispensing system which can be readily and securely attached to the rim of a toilet bowl. Moreover, the mounting device can be used to operate the valve of the dispensing container by the vertical movement of the toilet seat. These and other advantages of the invention will become more apparent from the following detailed description of the invention when taken in conjunction with the attached exemplary drawings.

BRIEF DESCRIPTION OF THE DRAWINGS

FIG. 4 is a cross-sectional view similar to FIG. 3 of an alternate embodiment which dispenses liquid into the toilet bowl.

FIG. 5 is a cross-sectional view of the bulb taken along the lines 5—5 shown in FIG. 4.

FIG. 6 is a perspective view of an alternative embodiment wherein two dispensing containers are supported on one of the depending legs of the support bracket.

FIG. 7 is a perspective view, partially exploded, of an alternative embodiment with a different arrangement of the supporting arms or levers.

FIG. 8 is a cross-sectional view similar to those shown in FIGS. 3 and 4 of an embodiment wherein dispensing containers are supported on both sides of the toilet bowl rim on each of the depending legs of the bracket.

In the drawings all corresponding parts are numbered the same.

DETAILED DESCRIPTION OF THE PREFERRED EMBODIMENTS

Figure 1:
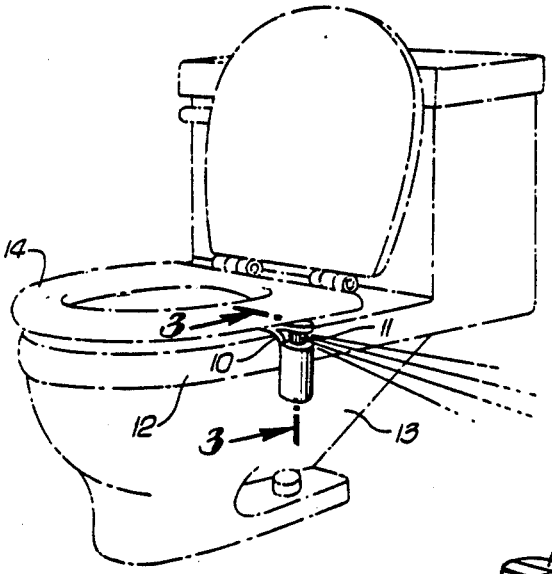
FIG. 1 is a perspective view of a toilet having attached to the rim thereof a support bracket and dispensing container incorporating features of the invention.

Reference is made to FIG. 1 which illustrates a support bracket 10 holding a dispensing container 11 mounted on the rim 12 of the toilet bowl 13 (shown in phantom). Vertical movement of the toilet seat 14 which is hingedly mounted to the rear portion of the toilet bowl 13 activates the dispensing container 11.

Figure 2:
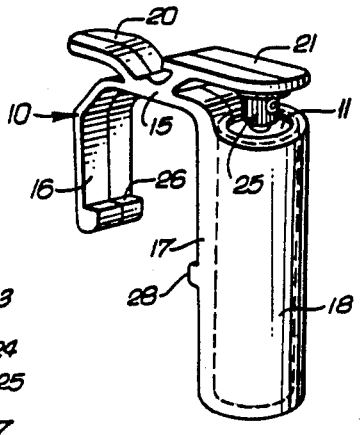
FIG. 2 is a perspective view of the support bracket and dispensing container shown in FIG. 1.
Figure 3:
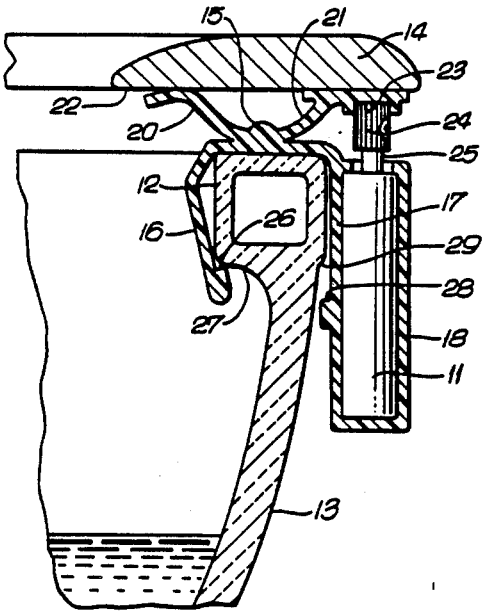
FIG. 3 is a cross-sectional view of the support bracket and dispensing container taken along the lines 3—3 shown in FIG. 1.

The support bracket 10 and the dispensing container 11 are more completely illustrated in FIGS. 2 and 3. As shown in these drawings, the bracket 10 comprises a cross member 15 which is shaped to fit transversely over the rim 12 of the toilet bowl 13. Two depending legs, internal leg 16 and external leg 17, are fixed to the cross member 15. Container support cylinder 18 is formed integrally with depending leg 17. Arms or levers 20 and 21, which extend upwardly and outwardly, are provided on the upper portion of the cross member 15 and are adapted to engage the undersurface 22 of toilet seat 14 to thereby flexibly support the toilet seat 14 without creating significant torsional moments on the bracket 10 which can displace the bracket from its proper position on the rim 12. This latter point is very important from the standpoint that displacement of the bracket 10 on the rim 12 can interfere with the operation of the dispenser by the vertical movement of the toilet seat 14.

The underside of arm 21 is preferably provided with a cavity 23 into which fits the push button 24 of the dispensing valve 25 so that valve 25 is actuated when the toilet seat 14 pushes down on arm 21. The dispensing container 11 is preferably designed to spray only on the downstroke (e.g., as with a pump dispenser) or other short term sequence so that excessive amounts of the material are not sprayed or otherwise dispensed.

Inner depending leg 16 is provided with an inwardly directed shoulder or flange 26 which preferably provides for a snap-fit mounting on the rim 12 whereby the shoulder or flange 26 fits under the lower edge 27 of the rim 12. The shoulder 26 also aids in preventing rotational movement when the arm 21 engages the button 24 to activate the valve 25 on dispensing container 11. The outer depending leg 17 is also provided with a shoulder or projection 28 which engages the underside 29 of rim 12, but a snug fit is not as advantageous with leg 17 as with leg 16 as previously described.

FIGS. 4 and 5 illustrate an embodiment for dispensing liquid, such as disinfectants, cleaning agents and the like, over a period of time into the toilet bowl. The support bracket 30 shown in FIG. 4 is essentially the same as bracket 10 shown in FIGS. 2 and 3, except that a passageway 31 is provided in the cross member 15 to accommodate a tube 32 which passes therethrough. Tube 32 is fixed at the proximal end thereof in fluid communication with valve 25 and is adapted to direct fluid dispensed thereby into the interior of the toilet bowl 13. A narrow channel 33 is provided on the outer surface of depending leg 16 so that a slightly larger tube 32 can be pushed into the channel 33 and thereby be held against the surface of leg 16. A bulb 34 is fixed to the distal end of tube 32 with a discharge opening 35 provided therein to discharge fluid 36 into the toilet bowl 13. An opening 37 is provided in the tube 32 proximal to the distal end thereof in order to control the discharge rate of fluid 36 out of the bulb 34. The larger the opening 37, the greater the discharge rate of fluid from bulb 34.

Embodiments for holding two dispensing containers are illustrated in FIGS. 6 and 8. In FIG. 6 both containers are supported on the outer depending leg of the support bracket 40, with one of the containers provided with a tube 32 for directing dispensed liquid material into the interior of the toilet bowl 13 as shown in FIGS. 4 and 5. The bracket 40 is essentially the same as bracket 10 shown in FIGS. 1–4, except that the support means 41 is wide enough to support two dispensing containers 11. One of the containers 11 is connected to tube 32 as shown in FIG. 4. Both valves 25 are actuated by arm 42.

In the embodiment shown in FIG. 8 each of depending legs 50 and 51 on bracket 52 are provided with support means 53 and 54 comprising open top cylinders for holding dispensing containers 11. The lower portions of legs 50 and 51 are modified over legs 16 and 17 shown in the prior Figures in that the lower portions of legs 50 and 51 are bent inwardly with a dog leg shape to provide a snug fit between the bracket 52 and the toilet bowl rim 12.

FIG. 7 represents an additional alternate embodiment which includes a change in the structure of the bracket 60 whereby arms 61 and 62 extend from one end of the cross member 63. The functions of the arms 61 and 62 are essentially the same as the arms 20 and 21 of the prior embodiments. The arms 61 and 62 may be formed integrally with the bracket 60 or may be mechanically or adhesively fixed thereto. The holding means 64 on the depending leg 65 include a generally U-shaped cylinder wall 66 with tongues 67 and 68 on each side thereof to interfit with grooves 69 and 70 provided on each side of the depending leg 65. A braced, open support ring 71 is provided on the outer surface of depending leg 65 to engage the collar 72 of container 11. The operation of this system is essentially the same as the embodiments shown in the prior systems.

The extent of arm movement, and thus toilet seat movement, required to actuate the valve on the dispensing container is relatively small. The arms on the bracket hold the toilet seat off of the rim when no one is sitting thereon, but they are designed to bend or flex under the weight of a person sitting thereon. The final position of the toilet seat on the rim is preferably controlled by the rubber bumpers or lugs normally found on the underside of the toilet seats in order to avoid applying significant amounts of weight to the push button of the valve which can damage the dispensing mechanism.

The mounting device of the invention can be made from a wide variety of materials, including thermal plastic and thermal setting plastic materials and metals.

While the invention has been described herein primarily in terms of a dispensing container which dispenses material upon the downstroke of the valve, i.e., when the toilet user sits on the toilet seat, it is obvious that the dispensing valve or the support structure can be modified to dispense material when the toilet user rises from the toilet seat. Additionally, while the dispenser has been described as a pumping dispenser, the system could be suitably modified to accomodate dispensing containers with gaseous propellants, such as low boiling point alkanols and chloro and/or fluoroalkanes.

Other modifications can be made to the invention without departing from the scope thereof.

What is claimed is:

1. A dispensing system including a dispensing container with dispensing means at the upper end thereof and a U-shaped support bracket for supporting the container which is adapted to be mounted on the rim of a toilet bowl with a toilet seat hingedly mounted on the rear portion of the toilet bowl rim and adapted to actuate the dispensing means thereof, the bracket comprising:

a cross member shaped to fit transversely on the upper surface of the toilet bowl rim;

inner and outer depending legs fixed to the cross member;

means provided on at least one of the depending legs to support in an upright position the dispensing container;

at least two arms extending upwardly from the cross member and adapted to separately flexibly engage the underside of the toilet seat in a manner so that the arms prevent application of torsional moments to the support bracket when the toilet seat is pivotted downwardly against the support bracket; and means responsive to vertical movement of the toilet seat to activate the dispensing means on the dispensing container to dispense material therefrom.

2. A dispensing system as set forth in claim 1, wherein the underside of one of the arms is adapted to contact and activate the dispensing means.

3. A dispensing system as set forth in claim 1, wherein the at least two arms extend upwardly and outwardly from the center portion of the cross member so that one of said arms extends over the dispensing means and is adapted to activate the dispensing means upon the vertical movement of the toilet seat, the underside of the arm extending over the dispensing means being provided with a cavity adapted to receive at least a portion of the dispensing means therein.

4. A dispensing system as set forth in claim 1, wherein the at least two arms extend from one end of the cross member and comprise a long arm and a short arm, the long arm actuating the dispensing means to dispense material from the dispensing container upon the vertical movement of the toilet seat.

5. A dispensing system as set forth in claim 1, wherein one of the depending legs is provided with means to support two dispensing containers, and wherein a tube is provided having the proximal end thereof in fluid communication with the dispensing means of at least one dispensing container, and the distal end of the tube is directed to the interior of the toilet bowl.

6. A dispensing system as set forth in claim 5, wherein the tube in fluid communication with the dispensing means is provided on the distal end thereof with a bulb having a discharge opening, and an opening proximal to the distal end which controls the discharge of fluid from the discharge opening in the bulb.

7. A dispensing system as set forth in claim 1, wherein each of the depending legs is provided with means to support a dispensing container, and wherein a tube is provided having the proximal end thereof in fluid communication with the dispensing means of at least one dispensing container, and a distal end of the tube is directed to the interior of the toilet bowl.

8. A dispensing system as set forth in claim 7, wherein the tube in fluid communication with the dispensing means is provided on the distal end thereof with a bulb having a discharge opening, and an opening proximal to the distal end thereof which controls the discharge of fluid from the discharge opening in the bulb.

9. A dispensing system as set forth in claim 1, wherein the means to support the dispensing container on a depending leg comprises an open top cylinder, and wherein a dispensing container is positioned within the support means provided therefor.

10. A dispensing system, comprising:

a dispensing container with dispensing means at the upper end thereof; and a U-shaped support bracket for supporting the dispensing container, which is adapted to be mounted on the rim of a toilet bowl with a toilet seat hingedly mounted on the rear portion of the toilet bowl rim and adapted to actuate the dispensing means thereof, the support bracket including:

a cross member shaped to fit transversely on the upper surface of the toilet bowl rim;

inner and outer depending legs fixed to the cross member wherein at least one the depending legs is provided with an inwardly directed shoulder or flange which fits under the lower edge of the toilet bowl rim, and wherein the other depending leg is provided with means to support the dispensing container;

a first arm extending upwardly from the cross member and adapted to flexibly engage the underside of the toilet seat; and a second arm extending upwardly from the cross member and also being adapted to flexibly engage the underside of the toilet seat in a manner whereby the first and second arms prevent application of torsional moments to the support bracket when the toilet seat is pivotted downwardly against the support bracket, the underside of the second arm being adapted to contact and activate the dispensing means and cause the dispensing of material from the dispensing container when the toilet seat moves downwardly, the underside of the second arm further being provided with a cavity adapated to receive a portion of the dispensing means therein.

* * * * .*